US007895771B2

(12) United States Patent
Prajescu et al.

(10) Patent No.: US 7,895,771 B2
(45) Date of Patent: Mar. 1, 2011

(54) CLOTHES DRYER WITH THERMAL INSULATION PAD

(75) Inventors: Silvia Ionelia Prajescu, Dollard des Ormeaux (CA); Pasquale Antonio Renzo, Anjou (CA)

(73) Assignee: Mabe Canada Inc., Burlington (CA)

( * ) Notice: Subject to any disclaimer, the term of this patent is extended or adjusted under 35 U.S.C. 154(b) by 181 days.

(21) Appl. No.: 12/232,210

(22) Filed: Sep. 12, 2008

(65) Prior Publication Data

US 2009/0260248 A1 Oct. 22, 2009

(30) Foreign Application Priority Data

Apr. 18, 2008 (CA) ..... 2629470

(51) Int. Cl.
*F26B 19/00* (2006.01)

(52) U.S. Cl. ..... 34/603; 34/606; 34/609; 34/130; 34/597; 34/201; 68/12.16; 68/5 C; 68/3 R; 318/799; 219/521; 454/241; 138/114; 138/115

(58) Field of Classification Search ..... 34/603, 34/606, 609, 130, 597, 201; 68/12.16, 5 C, 68/3 R; 318/799; 219/521; 454/241
See application file for complete search history.

(56) References Cited

U.S. PATENT DOCUMENTS

| | | | | | |
|---|---|---|---|---|---|
| 2,369,366 | A | * | 2/1945 | O'Neill | 34/267 |
| 2,372,790 | A | * | 4/1945 | Morgenstern | 34/609 |
| 2,460,422 | A | * | 2/1949 | Koppel | 34/606 |
| 2,498,172 | A | * | 2/1950 | Mintner et al. | 432/107 |
| 2,503,329 | A | * | 4/1950 | Geldhof et al. | 34/604 |
| 2,506,517 | A | * | 5/1950 | Moore | 432/44 |
| 2,521,712 | A | * | 9/1950 | Geldhof | 34/82 |
| 2,540,955 | A | * | 2/1951 | Moore | 34/605 |
| 2,547,238 | A | * | 4/1951 | Tremblay | 34/603 |
| 2,587,646 | A | * | 3/1952 | O'Neil | 34/601 |
| 2,589,284 | A | * | 3/1952 | O'Neil | 34/77 |
| 2,608,769 | A | * | 9/1952 | O'Neil | 34/131 |
| 2,617,203 | A | * | 11/1952 | Murray | 34/82 |
| 2,619,737 | A | * | 12/1952 | Geldhof et al. | 34/604 |
| 2,675,628 | A | * | 4/1954 | O'Neil | 34/75 |
| 2,688,806 | A | * | 9/1954 | Long | 34/75 |
| 2,707,837 | A | * | 5/1955 | Paulsen et al. | 34/607 |
| 2,718,711 | A | * | 9/1955 | Clark | 34/75 |
| 2,722,750 | A | * | 11/1955 | Smith et al. | 34/82 |
| 2,722,751 | A | * | 11/1955 | Steward | 34/82 |
| 2,728,481 | A | * | 12/1955 | Robinson et al. | 220/4.02 |
| 2,751,688 | A | * | 6/1956 | Douglas | 34/82 |
| 2,752,694 | A | * | 7/1956 | McCormick | 34/60 |
| 2,755,564 | A | * | 7/1956 | Wallis et al. | 34/604 |
| 2,780,009 | A | * | 2/1957 | Stickel | 34/76 |

(Continued)

FOREIGN PATENT DOCUMENTS

GB 2253035 A * 8/1992

(Continued)

*Primary Examiner* — Stephen M. Gravini

(57) ABSTRACT

A clothes dryer has a thermal insulation pad placed in a confined space in the dryer cabinet between the blower fan housing and the dryer cabinet side wall closest to the blower fan housing. The thermal insulation pad is press fit into the space so as to take up much of the volume of the confined space preventing the accumulation of dust or lint over time in the confined space while also preventing the flow of oxygen to the confined space. Accordingly, the thermal insulation pad reduces the risk of a fire starting in the confined area of the dryer cabinet between the blower wheel housing and the adjacent side wall of the cabinet. A thermal insulation pad also acts as sound insulation.

6 Claims, 4 Drawing Sheets

U.S. PATENT DOCUMENTS 2,792,640 A * 5/1957 Patterson ..... 34/75
2,798,307 A * 7/1957 Reiter ..... 34/610
2,813,353 A * 11/1957 McMillan ..... 34/79
2,814,130 A * 11/1957 Cayot ..... 34/82
2,814,886 A * 12/1957 Fowler ..... 34/605
2,817,157 A * 12/1957 McCormick ..... 34/82
2,843,945 A * 7/1958 Whyte ..... 34/82
2,851,793 A * 9/1958 Thompson ..... 34/601
2,871,576 A * 2/1959 Ramey ..... 34/87
2,893,135 A * 7/1959 Smith ..... 34/610
2,913,832 A * 11/1959 Kaufman ..... 34/80
2,921,384 A * 1/1960 Smith ..... 34/75
2,925,665 A * 2/1960 Smith ..... 34/82
2,958,138 A * 11/1960 Ashby ..... 34/601
2,958,139 A * 11/1960 Smith ..... 34/604
2,959,044 A * 11/1960 Stone ..... 68/12.15
2,959,867 A * 11/1960 Doty ..... 34/82
3,009,259 A * 11/1961 Simpson ..... 34/601
3,022,580 A * 2/1962 Doty ..... 34/60
3,027,653 A * 4/1962 Long et al. ..... 34/86
3,060,593 A * 10/1962 Flora et al. ..... 34/601
3,061,942 A * 11/1962 Scofield ..... 34/82
3,155,462 A * 11/1964 Erickson et al. ..... 34/82
3,197,886 A * 8/1965 Brame et al. ..... 34/90
3,263,343 A * 8/1966 Loos ..... 34/82
3,270,436 A * 9/1966 Fairgrieve ..... 34/131
3,429,056 A * 2/1969 Metzger ..... 34/601
3,621,293 A * 11/1971 Heidtmann ..... 327/428
3,722,106 A * 3/1973 Takeyama et al. ..... 34/82
3,805,404 A * 4/1974 Gould ..... 34/75
3,854,219 A * 12/1974 Staats ..... 34/265
3,969,070 A * 7/1976 Thompson ..... 432/105
4,019,023 A * 4/1977 Marzonie et al. ..... 219/400
4,024,703 A * 5/1977 Hudson ..... 60/773
4,033,047 A * 7/1977 Kawai ..... 34/82
4,069,596 A * 1/1978 Sisler ..... 34/242
4,103,433 A * 8/1978 Taylor ..... 34/86
4,112,590 A * 9/1978 Muller ..... 34/75
4,207,686 A * 6/1980 Daily ..... 34/610
4,546,554 A * 10/1985 Bullock et al. ..... 34/554
4,621,438 A * 11/1986 Lanciaux ..... 34/77
4,638,573 A * 1/1987 Nakamura et al. ..... 34/82
4,689,896 A * 9/1987 Narang ..... 34/82
4,700,495 A * 10/1987 Drews et al. ..... 34/603
4,873,592 A * 10/1989 Dulaff et al. ..... 360/90
4,891,892 A * 1/1990 Narang ..... 34/86
4,899,464 A * 2/1990 Carr et al. ..... 34/604
4,953,365 A * 9/1990 Lang et al. ..... 62/381
5,020,330 A * 6/1991 Rhoades et al. ..... 62/63
5,136,792 A * 8/1992 Janecke ..... 34/78
5,206,754 A * 4/1993 Yano et al. ..... 359/196.1
5,279,047 A * 1/1994 Janecke ..... 34/78
5,463,821 A * 11/1995 Gauer ..... 34/261
5,657,720 A * 8/1997 Walters ..... 119/317
5,901,465 A * 5/1999 Boussetta et al. ..... 34/602
5,915,922 A 6/1999 Wiethe et al.
5,965,851 A * 10/1999 Herreman et al. ..... 181/200
5,992,039 A * 11/1999 Bunch et al. ..... 34/91
6,393,725 B1 * 5/2002 Smith et al. ..... 34/260
6,434,857 B1 * 8/2002 Anderson et al. ..... 34/595
6,494,245 B1 * 12/2002 Simone ..... 156/578
6,512,831 B1 1/2003 Herreman et al.
6,626,984 B1 * 9/2003 Taylor ..... 96/380
6,923,173 B2 * 8/2005 Schonberger, Sr. ..... 126/110 R
6,954,995 B2 * 10/2005 Kitamura et al. ..... 34/597
6,966,124 B2 * 11/2005 Ryu ..... 34/134
7,055,262 B2 * 6/2006 Goldberg et al. ..... 34/86
7,380,423 B1 * 6/2008 Musone ..... 68/20
2003/0000106 A1 * 1/2003 Anderson et al. ..... 34/598
2004/0134093 A1 * 7/2004 Han ..... 34/595
2004/0216326 A1 * 11/2004 Kitamura et al. ..... 34/597
2005/0076534 A1 * 4/2005 Ofosu-Asante et al. ..... 34/597
2005/0092316 A1 * 5/2005 Schonberger, Sr. ..... 126/110 R
2006/0046594 A1 3/2006 Starrett
2006/0117595 A1 * 6/2006 Virzi et al. ..... 34/607
2007/0175907 A1 8/2007 Kempe et al.
2008/0122300 A1 * 5/2008 Cho et al. ..... 310/43
2009/0133283 A1 * 5/2009 Ricklefs et al. ..... 34/476
2010/0050464 A1 * 3/2010 Krzelowski et al. ..... 34/380

FOREIGN PATENT DOCUMENTS

JP 07229867 A * 8/1995
JP 08080397 A * 3/1996
JP 2000225298 A * 8/2000
JP 2004194941 A * 7/2004

* cited by examiner

CLOTHES DRYER WITH THERMAL INSULATION PAD

FIELD OF THE INVENTION

The present invention relates to a clothes dryer having a thermal insulation pad strategically placed in the dryer cabinet relative to the blower fan housing to reduce the risk of fire starting in this area of the dryer cabinet or spreading through this area between the dryer drum and the lower portion of the dryer cabinet.

BACKGROUND OF THE INVENTION

Clothes dryers for domestic use typically comprise a rotating drum in which clothes are tumbled as warm air moves through the drum. Airflow through the drum is induced by a centrifugal fan, or blower fan, located in an exhaust duct that has an opening facing into the front open end of the dryer drum. This opening is typically covered by a grill. The exhaust duct has a lint filter for trapping lint particles from continuing to flow through the exhaust duct. The blower fan is in airflow communication with this exhaust duct to draw air from the duct through the fan and out through a tangential duct which airflow then turns and goes through an exhaust duct pipe exiting to the rear of the dryer. The blower fan is mounted generally within a blower wheel housing and the fan is driven by a motor. The blower fan is typically located below the dryer drum to one side thereof so as to optimize the use of space within the dryer cabinet.

In recent tests to determine fire hazards within the dryer, cheese cloth has been placed in a confined space between the outside wall of the blower wheel housing and the closest adjacent side wall panel of the dryer cabinet. The cheese cloth represents either dust or lint particles which over time might collect in this confined space. During the testing, the operation of the blower fan drawing heated air out of the dryer has a tendency to warm the blower wheel housing causing the cheese cloth placed in this location during the testing to catch fire. Moreover, this has resulted in additional cheese cloth placed outside the dryer side wall adjacent the location of the blower wheel housing to catch fire when the cheese cloth within the dryer catches fire due to heat being conducted by and through the cabinet side wall. Also, the confined space may act as a pathway along which fire may spread between the dryer drum and lower portion of the dryer cabinet. Accordingly, there is a need to reduce the risk of fire starting in the confined area between the blower wheel housing and the side wall of the dryer cabinet closest to the housing and to reduce the risk of fire spreading between the dryer drum and lower portion of the dryer cabinet via the confined space.

BRIEF DESCRIPTION OF THE INVENTION

The present invention relates to a clothes dryer having a thermal insulation pad that is placed within a confined space between the blower wheel housing and the dryer cabinet side wall closest thereto. By placing a thermal insulation pad strategically in this location, the pad fills up much of, if not all of, the volume of the confined space between the blower housing and the side wall of the cabinet closest thereto. Hence, the thermal insulation pad prevents the accumulation of combustible dust or lint over time in the confined space while also preventing the flow of oxygen to the confined space. Accordingly, the thermal insulation pad reduces the risk of a fire starting in the confined area of the dryer cabinet between the blower wheel housing and the adjacent side wall of the cabinet. Also, the thermal insulation pad acts as a barrier reducing the risk of fire, should one occur in the dryer drum or lower portion of the dryer cabinet, from spreading via the confined space between the dryer drum and lower portion of the dryer cabinet.

It should be understood that the thermal insulation pad utilized by the present invention may comprise any pad of material that has for example a plastic or woven material outer jacket with a fibrous filled material. The material does not have to resist high levels of heat because the blower fan housing does not rise to overly high temperatures during operation. Hence the thermal insulation pad only requires limited thermal insulation capabilities. In practice it has been found that padded material suitable for sound proofing works in this environment. Accordingly another advantage associated with a thermal insulation pad is that it provides some noise buffering or dampening by its placement in the confined space.

It should be further understood that the thickness of the thermal insulation pad may be chosen to be slightly greater than the width of the confined space where the blower wheel housing is closest to the closer one of the side walls whereby the thermal insulation pad is press fit into position. The width of the thermal insulation pad may be longer than the depth of the blower housing such that the thermal insulation pad extends beyond the blower housing and partially back rearwardly of the dryer adjacent the motor for driving the centrifugal fan of the blower housing. The length of the thermal insulation pad may be chosen to be greater than that of the height of the blower housing such that the thermal insulation pad may be bent to follow the rounded contour of the blower wheel and may be held in place by simple means of suitable tape, such as, for example, duct tape adhering to both the thermal insulation pad and the blower wheel housing.

In accordance with one embodiment of the present invention, a clothes dryer comprises a cabinet having a pair of side walls, a drum mounted for rotation in the cabinet, and a blower wheel housing supporting a blower fan for moving air through the drum. The blower wheel housing is mounted in the cabinet generally below the dryer drum and to one side thereof, and is closer to one of the pair of side walls. A confined space is located between the blower wheel housing and the closer one of the side walls. The clothes dryer further comprises a thermal insulation pad positioned in the confined space between the blower wheel housing and the closer one of the side walls.

BRIEF DESCRIPTION OF THE DRAWINGS

For a more thorough understanding of the nature and objects of the present invention reference may be had, by way of example, to the accompanying diagrammatic drawings in which.

DETAILED DESCRIPTION OF THE INVENTION

Figure 1:
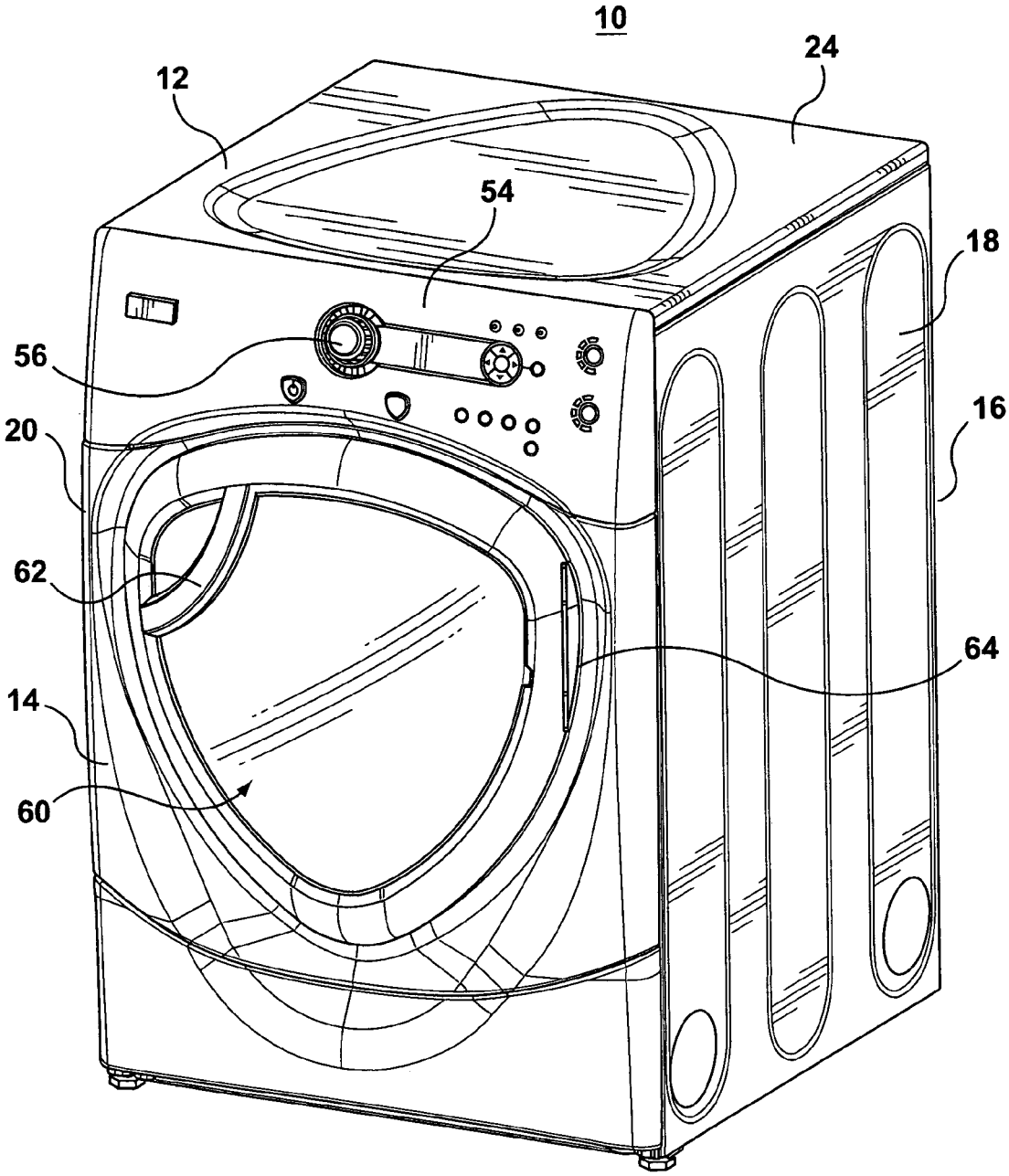
FIG. 1 is a perspective view of an exemplary clothes dryer that may benefit from the present invention.
Figure 2:
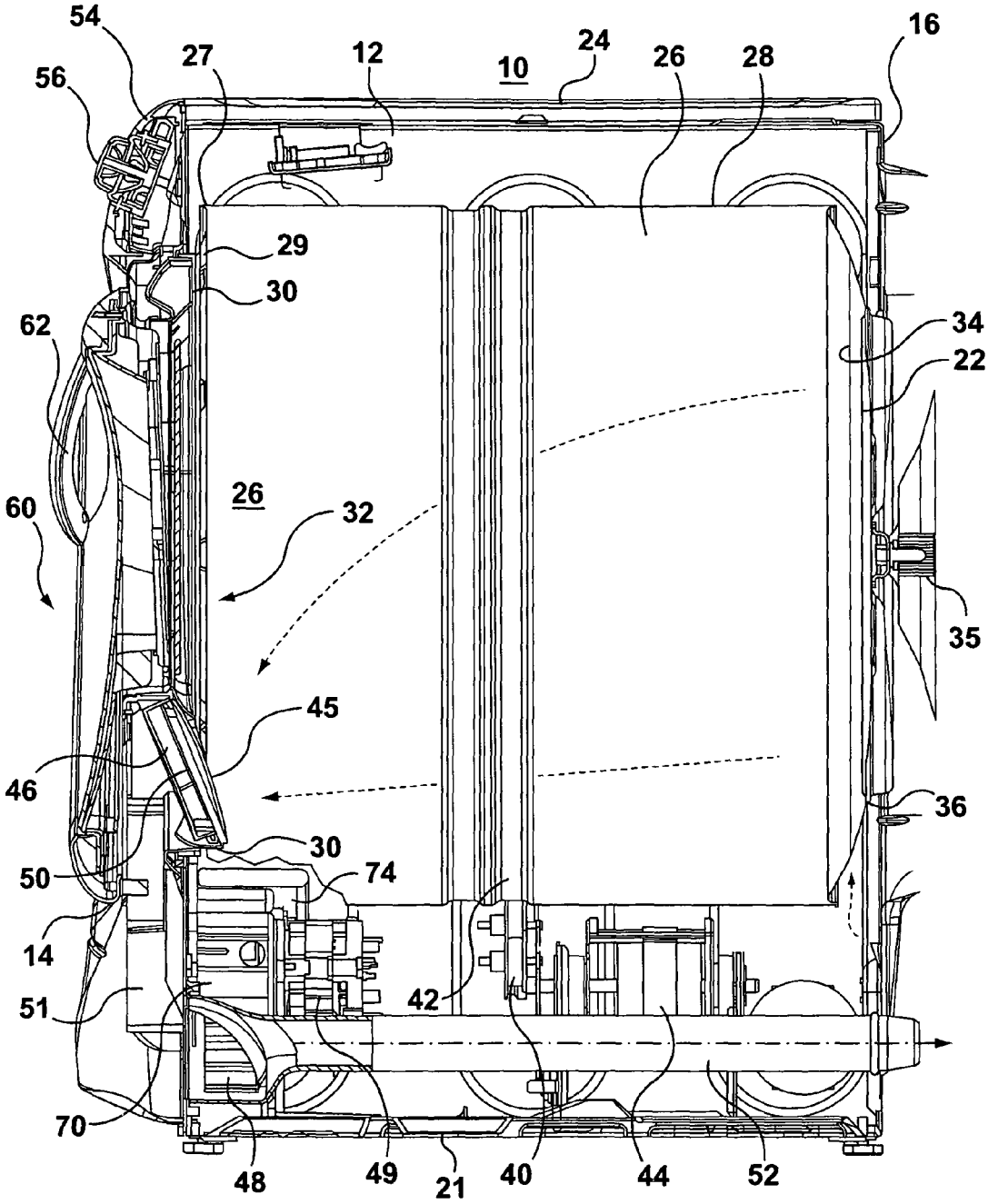
FIG. 2 is a side sectional view of an exemplary clothes dryer that may benefit from the present invention wherein a front lower portion of the drum has been broken away in the illustration.

FIGS. 1 and 2 show perspective and side sectional views of an exemplary clothes dryer 10 that may benefit from the present invention. The clothes dryer 10 includes a cabinet or a main housing 12 having a front wall 14, a rear wall 16, a pair of side walls 18 and 20 spaced apart from each other by the front and rear walls, a floor 21 and a top cover 24. Within the housing 12 is a drum or container 26 mounted for rotation around a substantially horizontal axis. A motor 44 rotates the drum 26 about the horizontal axis through, for example, a pulley 40 and a belt 42. The drum 26 is generally cylindrical in shape, has an outer cylindrical wall 28, and has an open end 27 that typically comprises a metal ring 29 attached by welding to the drum 26 for reducing the diameter of the opening of the drum 26 to match a front bulkhead wall or front bearing 30. The bearing 30 further defines an opening 32 into the drum 26. Clothing articles and other fabrics are loaded into the drum 26 through the opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by bearing 35. The rear wall 34 includes a plurality of holes (not shown) that receive hot air that has been heated by a heater such as electrical heating elements (not shown) in the heater housing 22. The heater housing 22 receives ambient air via an inlet 36. Although the exemplary clothes dryer 10 shown in FIG. 1 is an electric dryer, it could just as well be a gas dryer having a gas burner.

Heated air is drawn from the drum 26 by a blower fan 48 which is also driven by a second motor 49 in the embodiment shown. In an alternative embodiment, motor 44 could be used to drive blower fan 48. The air passes through a grill 45 and screen filter 46. Grill 45 keeps clothing articles tumbling in the drum 26 from contacting the filter 46 and touching the lint trapped by the filter 46 within the trap duct 50. As the air passes through the screen filter 46, it flows through lower duct portion 51 and is drawn by blower wheel 48 attached to motor 49 out of the clothes dryer through an exhaust duct 52. In this embodiment, the drum 26 is in air flow communication with the trap duct 50 whose lower duct portion 51 has an outlet that is in air flow communication with the blower wheel 48 and the exhaust duct 52. The exhaust duct 52 passes through the rear panel 16 and is usually connected to suitable venting (not shown) that provides an exhaust path for the dryer heated air to leave the room where the dryer 10 is located.

After the clothing articles have been dried, they may be removed from the drum 26 via the opening 32. Opening 32 is shown closed by a window or port-hole like door 60. Door 60 has a handle 62 for pivotally opening the door about hinge 64.

The dryer 10 is shown to have a control panel 54 with touch and or dial controls 56 that permit the user to control operation of dryer 10.

Figure 3:
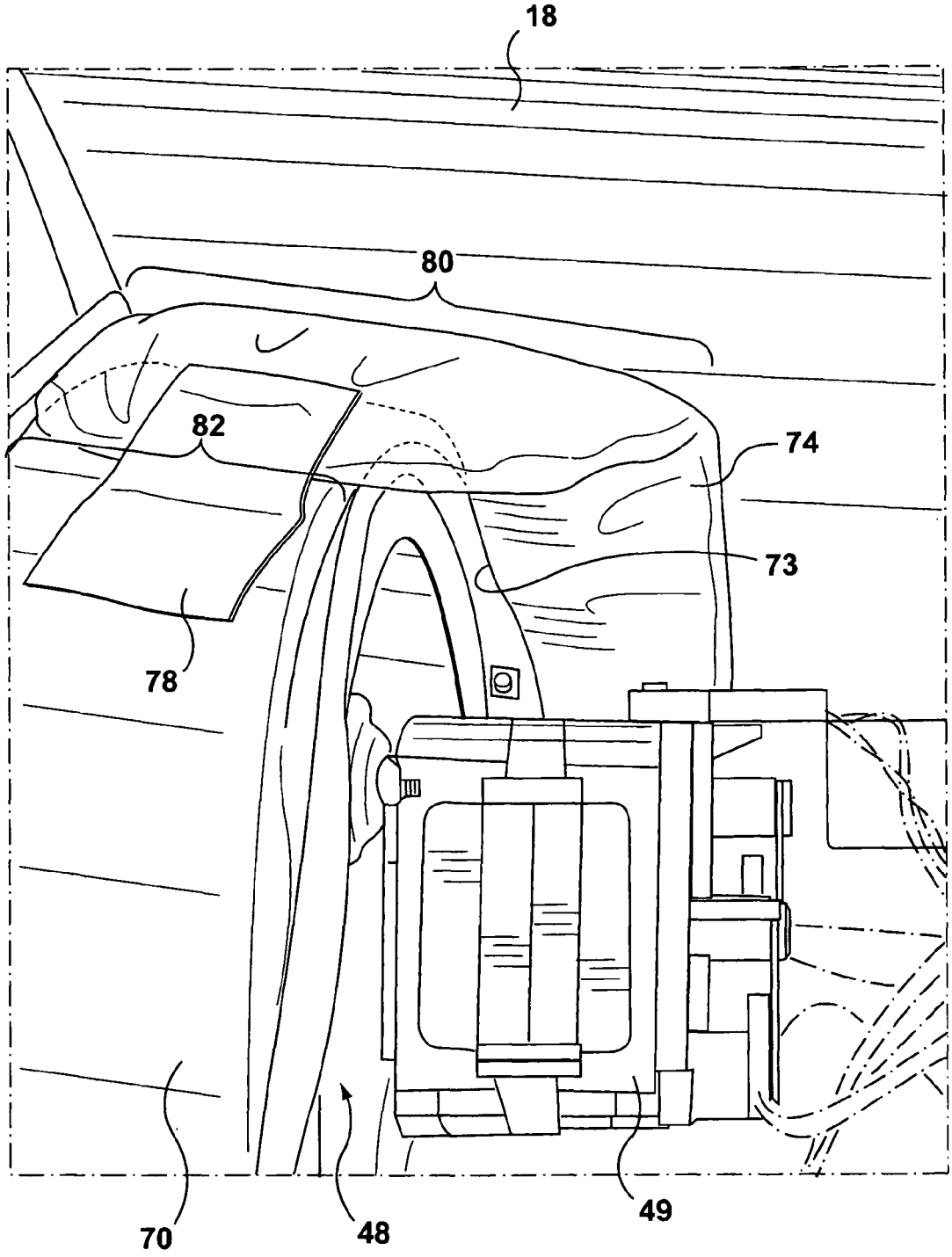
FIG. 3 is an enlarged perspective view of the exemplary clothes dryer showing the thermal insulation pad located in the dryer cabinet partially surrounding the blower wheel housing; and, FIG. 4 is a front sectional view showing the location of the thermal insulation pad relative to the blower housing and side wall of the cabinet.
Figure 4:
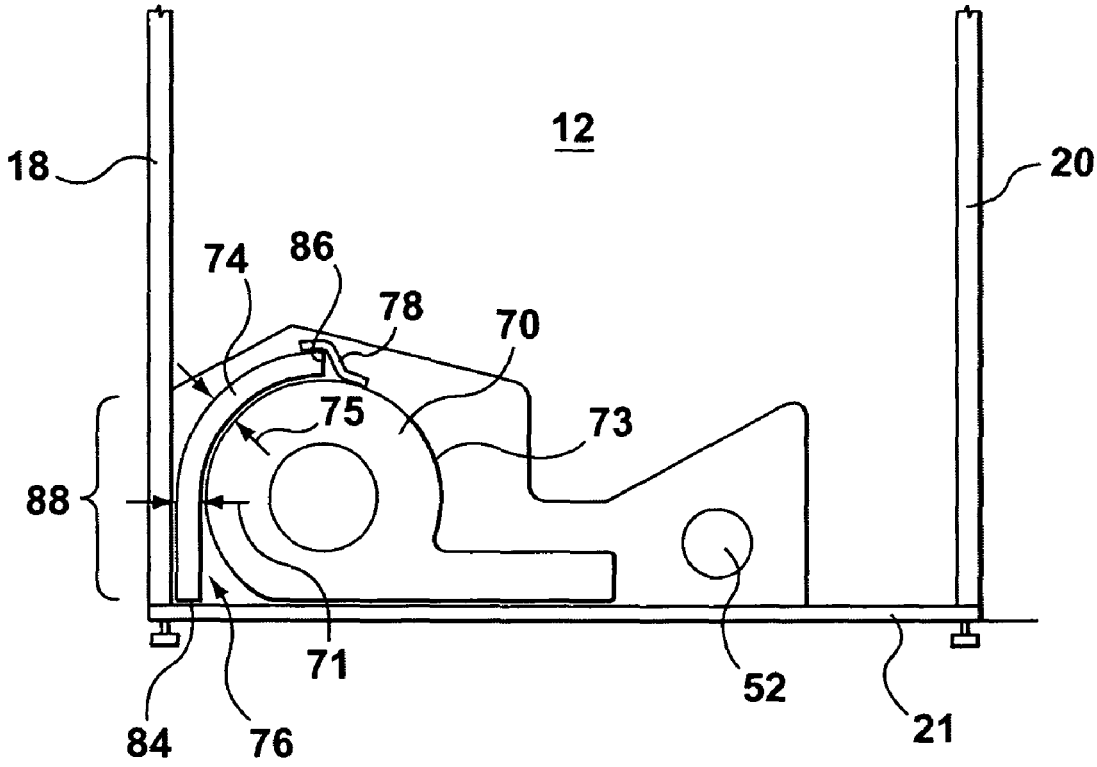

Referring to FIGS. 2, 3 and 4, there is shown a thermal insulation pad 74 positioned to partially surround the outer circumference of the blower wheel housing 70. The thermal insulation pad 74 is located in confined space 76 between the side wall 18 and the cylindrical end wall 73 of the blower wheel housing 70. It should be noted from the drawings that the side wall 18 is the closer of side walls 18 and 20 to the blower wheel housing 70.

As best seen in FIG. 4, the thermal insulation pad 74 is press fit into a confined space 76 between side wall 18 and the cylindrical end wall 73 of the blower wheel housing 70. The thermal pad 74 has a thickness 75 which is greater than the distance 71 between the side wall 18 and the blower wheel housing 70. Thermal insulation pad 74 is bent to follow the contour of the end wall 73 and a piece of duct tape 78 is used to secure the thermal insulation pad 74 relative to the blower wheel housing 70. The blower wheel has a width 80 (see FIG. 3) which is greater than the depth 82 of the blower wheel housing 70 such that the pad 74 extends rearwardly of the dryer cabinet and partially overlaps a portion of the motor 49 used to drive the blower fan 48 found in the blower wheel housing 70. As shown in FIG. 3, the length of the thermal insulation pad 74 between its lower end 84 and its upper bent end 86 is greater than the height 88 of the blower wheel housing so as to allow the thermal insulation pad to be partially bent and overlap an upper portion of the cylindrical end wall 73 of the blower wheel housing 70. It should be understood that in an alternative embodiment the length and/or width of the thermal pad 74 maybe chosen to be different so long as its overall dimensions reduce the risk of fire starting in the confined space 76.

The thermal insulation pad 74 preferably comprises a fiberglass woven material located within either a woven material jacket or a plastic enclosure such that the pad 74 fills much of the volume of the confined space 76 between the blower wheel housing 70 and the adjacent side wall panel 18. This prevents the accumulation of lint or dust over a period of time and also does not allow oxygen into this area thereby precluding the starting of a fire in this confined space 76 of the cabinet 12. It should be understood that any suitable insulation material may be used and that the insulation material need not necessarily be flexible to bend around the cylindrical end wall 71 of the blower wheel housing 70. In an alternative embodiment it is envisaged that a stiffer material may be utilized which extends vertically up between the blower wheel housing and the side panel 18. Furthermore, the thermal insulation provided by the thermal insulation pad 74 acts as sound proofing insulation. Accordingly a secondary advantage associated with the use of a thermal insulation pad is it provides a sound buffer or dampener for noise associated with the blower wheel housing 70 adjacent the side wall 18.

While the invention has been described in terms of various specific embodiments, those skilled in the art will recognize that the invention can be practiced with modifications within the scope of the present invention as disclosed herein.

What is claimed is:

1. A clothes dryer comprising:

a cabinet having a pair of side walls;

a drum mounted for rotation in the cabinet;

a blower wheel housing supporting a blower fan for moving air through the drum, the blower wheel housing being mounted in the cabinet generally below the dryer drum and to one side thereof and being closer to one of the pair of side walls;

a confined space located between the blower wheel housing and the closer one of the side walls;

a thermal insulation pad positioned in the confined space between the blower wheel housing and the closer one of the side walls; and, wherein the thickness of the thermal insulation pad is chosen to be slightly greater than the width of the confined space where the blower wheel housing is closest to the closer one of the side walls whereby the thermal insulation pad is press fit into position between the blower wheel housing and the closer one of the side walls and whereby the thermal insulation pad prevents accumulation of combustible dust and lint in the confined space.

2. The clothes dryer of claim 1 wherein blower wheel housing has a cylindrical end wall and the thermal insulation pad is flexible and is bent to follow an upper portion of the cylindrical end wall.

3. The clothes dryer of claim 2 wherein an end portion of the thermal insulation pad is secured to the cylindrical end wall by tape.

4. The clothes dryer of claim 1 wherein the thermal insulation pad has a width greater than the depth of the blower wheel housing whereby the thermal insulation pad extends rearwardly in the cabinet beyond the blower wheel housing to partially co-extend rearwardly with a motor for driving the blower fan.

5. The clothes dryer of claim 1 wherein the thermal insulation pad comprises an outer jacket that is one of woven material or plastic and an inner material that is fibrous.

6. The clothes dryer of claim 1 wherein the thermal insulation pad has soundproofing characteristics.

* * * * *